US009349328B2

(12) United States Patent
Onogi

(10) Patent No.: US 9,349,328 B2
(45) Date of Patent: May 24, 2016

(54) BACKLIGHT APPARATUS, METHOD FOR CONTROLLING THE SAME, AND IMAGE DISPLAY APPARATUS

(75) Inventor: Makoto Onogi, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 305 days.

(21) Appl. No.: 13/493,265

(22) Filed: Jun. 11, 2012

(65) Prior Publication Data

US 2013/0002529 A1 Jan. 3, 2013

(30) Foreign Application Priority Data

Jun. 29, 2011 (JP) ..... 2011-144101
Apr. 25, 2012 (JP) ..... 2012-100140

(51) Int. Cl.
*G09G 3/36* (2006.01)
*G09G 3/34* (2006.01)
*H05B 33/08* (2006.01)

(52) U.S. Cl.
CPC ..... *G09G 3/36* (2013.01); *G09G 3/342* (2013.01); *H05B 33/086* (2013.01); *G09G 2310/024* (2013.01); *G09G 2310/0237* (2013.01); *G09G 2320/0261* (2013.01); *G09G 2320/062* (2013.01); *G09G 2320/064* (2013.01); *G09G 2360/145* (2013.01)

(58) Field of Classification Search
CPC ..... H05B 33/086; G09G 3/36; G09G 2310/0237; G09G 2310/024; G09G 2320/0261; G09G 2320/064; G09G 2360/145; G09G 2320/062
USPC ..... 345/102, 345, 82, 83, 204; 315/169.1, 315/324; 362/249.02
See application file for complete search history.

(56) References Cited

U.S. PATENT DOCUMENTS

2009/0079363 A1* 3/2009 Ghoman et al. ..... 315/294
2009/0303172 A1* 12/2009 Park et al. ..... 345/102
2010/0134406 A1 6/2010 Maruyama et al.
2012/0147066 A1 6/2012 Fujiwara et al.

FOREIGN PATENT DOCUMENTS

JP 2005-099367 4/2005
JP 2006-323300 11/2006
JP 2010-153359 7/2010
WO 2010/122724 A1 10/2010
WO 2011/024497 A1 3/2011

OTHER PUBLICATIONS

The above patent documents were cited in the Mar. 1, 2016 Japanese Office Action, which is enclosed without an English Translation, that issued in Japanese Patent Application No. 2012-100140.

* cited by examiner

*Primary Examiner* — Shaheda Abdin
(74) *Attorney, Agent, or Firm* — Cowan, Liebowitz & Latman, P.C.

(57) ABSTRACT

Disclosed is a backlight apparatus comprising a plurality of light sources; and a control unit which drives the plurality of light sources at an identical driving frequency and which performs pulse-width modulation control for a turned-on period and a turned-off period of each of the light sources; wherein the control unit is capable of setting a duty ratio for each of the light sources and each of driving cycles; and the control unit sets the duty ratio for at least two of the light sources respectively so that a condition, in which one cycle period composed of one turned-on period and one turned-off period is N times the driving cycle, is fulfilled, and the duty ratio is 0 or 1 in at least one driving cycle of N pieces of the driving cycles for constructing the one cycle period if N is not less than 2.

19 Claims, 7 Drawing Sheets

BACKLIGHT APPARATUS, METHOD FOR CONTROLLING THE SAME, AND IMAGE DISPLAY APPARATUS

BACKGROUND OF THE INVENTION

1. Field of the Invention

The present invention relates to a backlight apparatus, a method for controlling the same, and an image display apparatus.

2. Description of the Related Art

Image display apparatuses, which use liquid crystal panels, are predominantly provided in recent years. The liquid crystal panel is not a self-emitting (self-luminous) device. Therefore, it is necessary to provide a backlight which uses a light source such as LED (light-emitting diode) or the like. In the case of the liquid crystal display apparatus, the luminance of the backlight is changed in some cases in order to regulate the luminance of a screen image (picture). PWM (pulse-width modulation) is exemplified as a method which is frequently used to adjust the luminance of the backlight. In this method, the backlight is turned ON and turned OFF in a certain cycle, and the ratio between the turned-on period and the turned-off period is changed to adjust the luminance of the backlight thereby. If the cycle of turning ON/OFF is long, then the light flashing is visually recognized by human eyes, and hence the flicker (flickering) is caused in some cases. Therefore, in the PWM control of the backlight, the backlight is generally subjected to the flashing at a high frequency of not less than 200 Hz.

In another viewpoint, the liquid crystal display apparatus is inferior in the response performance as compared with the self-emitting (self-luminous) device such as a CRT (cathode-ray tube) display, a plasma display and the like. Therefore, the moving image blur is sometimes conspicuous when a moving image is displayed. Various techniques have been suggested in order to reduce the moving image blur. A technique called "backlight scan" is present as one of such techniques.

The technique called "backlight scan" is the following technique. That is, the backlight is turned OFF in conformity with the scanning (scan) of the liquid crystal, and thus the moment, at which the liquid crystal is switched", cannot be seen so that the moving image blur is reduced thereby. In order to carry out this technique, it is necessary that the flashing frequency of the backlight should be conformed to the scanning frequency (frame frequency) of the liquid crystal. For this reason, it is necessary that the flashing frequency of the backlight should be lowered to 60 Hz, for example, when the scanning frequency of the liquid crystal is 60 Hz. Therefore, when the backlight scan is performed, then the moving image blur can be reduced, while the flicker is conspicuous in some cases. Therefore, if the backlight scan is performed when a still image is displayed, then the flicker is merely conspicuous, and no merit is obtained. Therefore, when the still image is displayed, it is appropriate that the backlight is subjected to the flashing at a high frequency without performing the backlight scan.

For example, a situation is assumed, in which a moving image is displayed on only a part of a screen, or a situation is assumed, in which a moving image is displayed on an entire screen but the extent or magnitude (speed) of the motion differs depending on the area in the screen. In such a situation, a high quality screen image (picture) is rather obtained such that the backlight scan is performed for only the area of the moving image or the area in which the motion is provided in a large amount, and the flashing of the backlight is performed at an ordinary frequency (high frequency) without performing the backlight scan for the other areas (area of the still image or the area in which the motion is provided in a small amount).

Japanese Patent Application Laid-open No. 2005-99367 discloses a relevant technique, i.e., such a technique that a backlight, which corresponds to a frame block judged to provide a moving image, is flashed, while a backlight, which corresponds to a frame block judged to provide a still image, is always turned ON.

Japanese Patent Application Laid-open No. 2006-323300 discloses such a technique that the speed of a moving image is detected when a still image and the moving image are displayed in a mixed manner so that the duty ratio of PWM is shortened to mitigate the moving image blur for an area in which the motion is fast, while the duty ratio is prolonged to suppress the flicker (flickering) for an area in which the motion is slow.

SUMMARY OF THE INVENTION

In the meantime, an LED driver IC, which is provided with the PWM control function, is generally used in order allow LED as the light source to emit the light in accordance with the PWM control as described above. FIG. 7 exemplarily shows an LED driver IC 7000 and LED strings (LED arrays connected in series) 7110, 7210, 7310, 7410, 7510, 7610, 7710, 7810 connected thereto. The LED driver IC 7000 ordinarily has a plurality of control channels 7100, 7200, 7300, 7400, 7500, 7600, 7700, 7800. Each one of the LED strings 7110, 7210, 7310, 7410, 7510, 7610, 7710, 7810 is connected to one channel of the channels described above.

One or more LED or LEDs 7111, 7112, 7113, and 7114 are connected in series to the LED string 7110. The same amount of current flows through the same LED string. Therefore, LEDs, which are connected to the same LED string, are turned ON/OFF simultaneously. The LED driver IC 7000 can control LEDs connected to the plurality of LED strings by means of one driver in accordance with PWM respectively, wherein the duty ratio of PWM can be changed for each of the channels. If one driver IC has only one control channel, and only one LED string can be connected thereto, then an enormous number of LED driver ICs are required for one liquid crystal display apparatus.

Therefore, the LED driver IC, which can control a plurality of LED strings, is generally used in view of, for example, the cost, the areal size of the substrate, and the generation of heat. Usually, the LED driver IC 7000 can be used while individually changing the duty ratio of PWM for each of the channels. On the other hand, as for the driving frequency of PWM, the driving can be generally performed only at an identical driving frequency for all of the channels.

One of the main causes of such a circumstance is considered as follows. That is, it is scarcely needed to change the driving frequency for each of the channels. Further, in order to change the driving frequency for each of the channels, the same number of clocks as the number of channels are required to serve as references. Therefore, another main cause is also considered as follows. That is, it is also necessary to provide the same number of clock sources and the same number of terminals for inputting the clocks into the LED driver ICs. For the reason as described above, even if the driving frequency of PWM can be changed for each of the channels, the clock sources are required in the amount corresponding to the number of channels. Therefore, the cost is consequently increased and the areal size of the substrate is consequently increased, which is not preferred.

In this case, it is assumed that the four driver ICs are used in total, and a display screen 600 is divided into four, i.e., an allotted area 601 of which the driver 1 is in charge, an allotted area 602 of which the driver 2 is in charge, an allotted area 603 of which the driver 3 is in charge, and an allotted area 604 of which the driver 4 is in charge, as shown in FIG. 6A. On this assumption, such a situation is considered as shown in FIG. 6B that an image, in which a still image 605 and a moving image 606 are present in a mixed manner, is displayed on the display screen 600.

In this situation, it is assumed as described above that the ordinary flashing at the high frequency is performed with the backlights which correspond to the area of the still image 605 and the backlight scan is performed with the backlights which correspond to the area of the moving image 606. In this case, the still image 605 and the moving image 606 are present in a mixed manner in the allotted area 601 of which the driver 1 is in charge. Therefore, it is necessary for the driver 1 to change the flashing frequency of LED depending on the channel. This situation also holds equivalently for the other areas 602, 603, 604.

Therefore, in order to perform the backlight scan for only the moving image area, it is necessary that LEDs should be subjected to the flashing at frequencies which are different for the respective channels by using the same LED driver. However, as described above, most of LED driver ICs, which are available in the present circumstances, cannot perform such an operation. Even if any LED driver IC can perform such an operation, a problem arises, for example, in relation to the increase in the cost.

Further, the use case, in which the flashing is performed at frequencies which are different for the respective LED strings, is also considered other than when the moving image area and the still image area are present in a mixed manner in one screen as described above. For example, a situation is assumed, in which the light emission amount is individually detected in relation to each of the LED strings in order to correct any uneven luminance.

The present invention has been made taking the foregoing circumstances into consideration, which provides such a technique that a plurality of light sources can be subjected to the flashing at different frequencies while driving the plurality of light sources at an identical driving frequency.

A first aspect of the present invention resides in a backlight apparatus comprising:

a plurality of light sources; and a control unit which drives the plurality of light sources at an identical driving frequency and which performs pulse-width modulation control for a turned-on period and a turned-off period of each of the light sources, wherein:

the control unit is capable of setting a duty ratio between the turned-on period and the turned-off period for each of the light sources and each of driving cycles; and the control unit sets the duty ratio, for at least two of the light sources respectively, so that a condition, in which one cycle period composed of one turned-on period and one turned-off period is N times the driving cycle (N is an integer of not less than 1), is fulfilled, and the duty ratio is 0 or 1 in at least one driving cycle of N pieces of the driving cycles for constructing the one cycle period if N is not less than 2.

A second aspect of the present invention resides in a method for controlling a backlight apparatus having a plurality of light sources which are driven at an identical driving frequency and each of which has a turned-on period and a turned-off period subjected to pulse-width modulation control, the method comprising:

a step of setting a duty ratio, for at least two of the light sources respectively, so that a condition, in which one cycle period composed of one turned-on period and one turned-off period is N times a driving cycle (N is an integer of not less than 1), is fulfilled, and the duty ratio is 0 or 1 in at least one driving cycle of N pieces of the driving cycles for constructing the one cycle period if N is not less than 2; and a step of establishing or setting the determined duty ratio for each of the light sources and each of the driving cycles.

According to the present invention, the plurality of light sources can be subjected to the flashing at different frequencies while driving the plurality of light sources at an identical driving frequency.

Further features of the present invention will become apparent from the following description of exemplary embodiments with reference to the attached drawings.

DESCRIPTION OF THE EMBODIMENTS

First Embodiment

Figure 1:
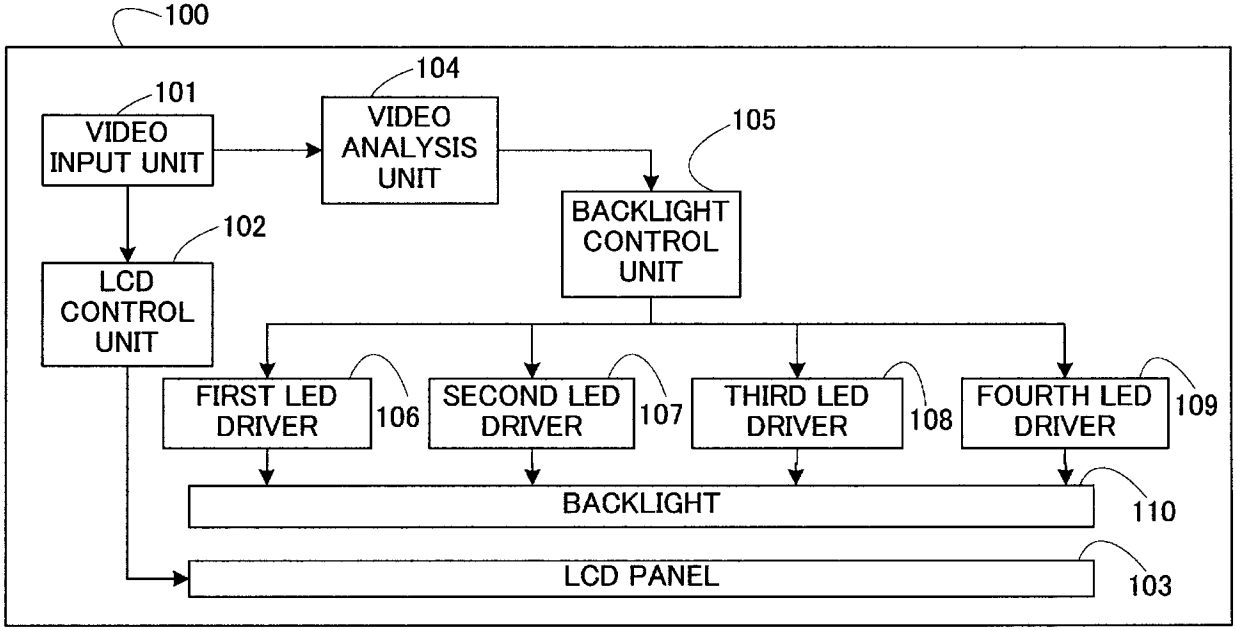
FIG. 1 schematically shows an image display apparatus according to an embodiment.

A first embodiment of the present invention will be explained. FIG. 1 shows a block diagram illustrating an outline of an image display apparatus according to the present invention. In the image display apparatus 100, the liquid crystal of a liquid crystal panel is oriented so that a screen image (picture) is displayed by controlling the LCD panel 103 by an LCD control unit 102 on the basis of a video signal (picture signal) inputted from a video input (picture input) unit 101. A video analysis unit 104 analyzes the inputted video signal to judge whether a displayed image, which is based on the video signal, is a still image or a moving image. An obtained judgment result is transmitted as video information (picture information) to a backlight control unit 105. Specifically, an area, in which the inter-frame difference of the pixel value is smaller than a predetermined value, is judged to be a still image area by the video analysis unit 104, while an area, in which the inter-frame difference of the pixel value is not less than the predetermined value, is judged to be a moving image area by the video analysis unit 104.

The backlight control unit 105 determines the control method for controlling the backlight on the basis of the video information to set the information required to control the backlight including, for example, the duty ratio and the current amount for LED drivers 106, 107, 108, 109. The LED drivers 106, 107, 108, 109 drive light sources of a backlight 110 at an identical driving frequency on the basis of the information received from the backlight control unit 105. It is possible to set the duty ratio for each of the light sources and each of the driving cycles. Each of the LED drivers controls the light emission of connected LEDs so that the flashing is performed at a constant frequency by using the PWM signal of the duty ratio and the current amount set by the backlight control unit 105. That is, each of the LED drivers controls the light emission of connected LEDs such that the duty ratio between the turned-on period and the turned-off period is set for each of the driving cycles to perform the pulse-width modulation control for the turned-on period and the turned-off period. The backlight 110 illuminates the LCD panel 103.

Figure 2A:
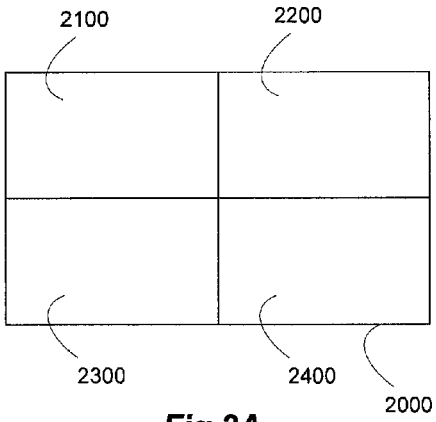
FIGS. 2A, 2B, and 2C illustrates areas of a display screen.
Figure 2B:
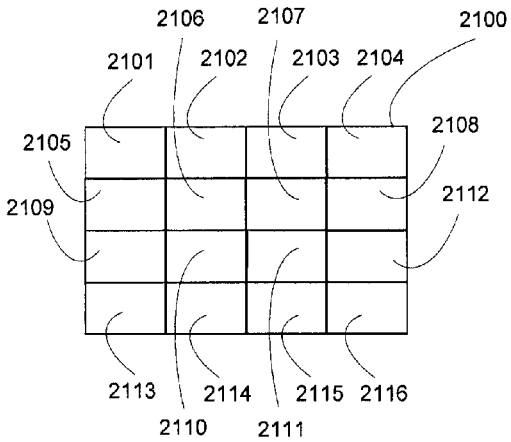

In this embodiment, a display screen 2000 is divided into four areas as shown in FIG. 2A. The control of the backlight corresponding to each of the areas is in charge of each of the LED drivers. In this embodiment, the first LED driver 106 is in charge of the area 2100, the second LED driver 107 is in charge of the area 2200, the third LED driver 108 is in charge of the area 2300, and the fourth LED driver 109 is in charge of the area 2400. Each of the LED drivers has LED connecting terminals of sixteen channels. As shown in FIG. 2B, the allotted area, of which each of the LED drivers is in charge, is divided in sixteen areas. One LED string corresponds to each of the areas. One LED or a plurality of LEDs, which is/are connected to one LED string, constitute/constitutes a light source block. The light emission of LED is controlled for each of the light source blocks. The area, which corresponds to one LED string in the backlight 110, is hereinafter referred to as "LED block".

The respective sixteen LED strings are connected to the sixteen channels of the LED driver respectively. The LED string is driven at an identical driving frequency for each of the channels, and the light emission is controlled in accordance with the PWM signal. FIG. 2B shows sixteen divided areas provided by dividing the area 2100. Each of the divided areas corresponds to one LED block. In this arrangement, the area 2100 is divided into a divided area 2101 of which a channel 1 of the first LED driver 106 is in charge, a divided area 2102 of which a channel 2 is in charge, a divided area 2103 of which a channel 3 is in charge, a divided area 2104 of which a channel 4 is in charge, a divided area 2105 of which a channel 5 is in charge, a divided area 2106 of which a channel 6 is in charge, a divided area 2107 of which a channel 7 is in charge, a divided area 2108 of which a channel 8 is in charge, a divided area 2109 of which a channel 9 is in charge, a divided area 2110 of which a channel 10 is in charge, a divided area 2111 of which a channel 11 is in charge, a divided area 2112 of which a channel 12 is in charge, a divided area 2113 of which a channel 13 is in charge, a divided area 2114 of which a channel 14 is in charge, a divided area 2115 of which a channel 15 is in charge, and a divided area 2116 of which a channel 16 is in charge. Each of the areas 2200, 2300, 2400 is also divided into divided areas for respective channels (for respective LED strings) in the same manner as described above. However, any explanation thereof is omitted herein.

Figure 2C:
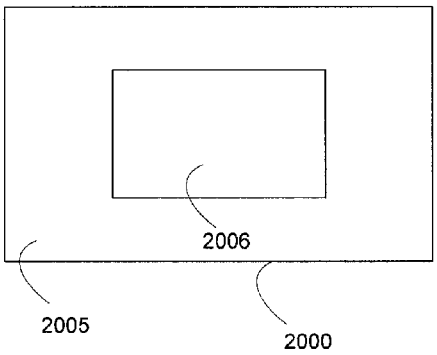

An explanation will be made about an exemplary operation wherein an image, which is composed of a moving image displayed in an area 2006 disposed at a central portion of the screen and a still image displayed in an area 2005 other than the area 2006 as shown in FIG. 2C, is displayed on the image display apparatus constructed as described above.

The backlight control unit 105 switches ON/OFF (flashes) LEDs of the LED blocks corresponding to the still image area 2005 at a high frequency in order to suppress the flicker in the still image display. That is, the backlight control unit 105 shortens one cycle period which is composed of one turned-on period and one turned-off period. The reciprocal of the one cycle period is hereinafter referred to as "flashing frequency". Further, it is assumed that the backlight control unit 105 performs the backlight scan by flashing LEDs of the LED blocks corresponding to the moving image area 2006 at a low frequency in order to suppress the moving image blur. That is, the backlight control unit 105 prolongs the one cycle period which is composed of one turned-on period and one turned-off period. In this embodiment, it is assumed that the flashing frequency, which is required for LEDs of the LED blocks corresponding to the still image area 2005, is 240 Hz, and the flashing frequency, which is required for LEDs of the LED blocks corresponding to the moving image area 2006, is 60 Hz. It is assumed that the duty ratio, which is required to obtain the required luminance, is identical for all of the channels, which is 60%. In this embodiment, an explanation will be made for only the control in relation to the area 2100 for the purpose of simplification. It is assumed that the backlight control unit 105 includes a storage unit which stores the correlation between the required luminance and the required duty ratio. As described above, the backlight scan is performed for the moving image area, and the flashing of the backlight is performed at the ordinary frequency (high frequency) without performing the backlight scan for the other area (still image area or area involving small amount of motion). Thus, it is possible to realize the display of high quality screen images (pictures) in both of the moving image area and the still image area.

The twelve divided areas 2101 to 2110, 2113, 2114, which are included in the area 2100 shown in FIG. 2B, are included in the still image area 2005. Therefore, it is necessary that the LED blocks, which correspond to these divided areas, should be flashed (subjected to the flashing) at 240 Hz. The four divided areas 2111, 2112, 2115, and 2116 are included in the moving image area 2006. Therefore, it is necessary that the LED blocks, which correspond to these divided areas, should be flashed at 60 Hz. In other words, it is necessary that the first LED driver 106 should flash the LED strings connected to the channels 1 to 10, 13, 14 at 240 Hz, and the first LED driver 106 should flash the LED strings connected to the channels 11, 12, 15, 16 at 60 Hz.

In this embodiment, if the required flashing frequency differs between the respective channels, the backlight control unit 105 sets the driving frequency of the LED driver IC to a frequency which is the least common multiple of the plurality of different flashing frequencies. In this embodiment, the LED string having the flashing frequency of 240 Hz and the LED string having the flashing frequency of 60 Hz are connected to the first LED driver 106. Therefore, the backlight control unit 105 sets the least common multiple of 240 Hz thereof as the driving frequency of the first LED driver 106. A procedure, in which the driving frequency of 240 Hz is used as a fixed value and the flashing frequency is set to be 1/N of the driving frequency (N is an integer of not less than 1), is also included in the present invention. That is, the present invention also includes such a procedure that the duty ratio between the turned-on period and the turned-off period is set so that a condition, in which one cycle period composed of one turned-on period and one turned-off period is N times the driving cycle (N is an integer of not less than 1), is fulfilled. In this embodiment, an explanation is made as exemplified by 240 Hz and 60 Hz as the plurality of different flashing frequencies. However, these values can be set arbitrarily. For example, the setting can be made to any flashing frequency designated by a user from a plurality of selectable flashing frequencies (for example, 240 Hz, 120 Hz, and 60 Hz). For example, the flashing frequency corresponding to the still image area may be set to 240 Hz, and the flashing frequency corresponding to the moving image area may be set to 120 Hz. Alternatively, the flashing frequency corresponding to the still image area may be set to 120 Hz, and the flashing frequency corresponding to the moving image area may be set to 60 Hz.

Figure 3A:
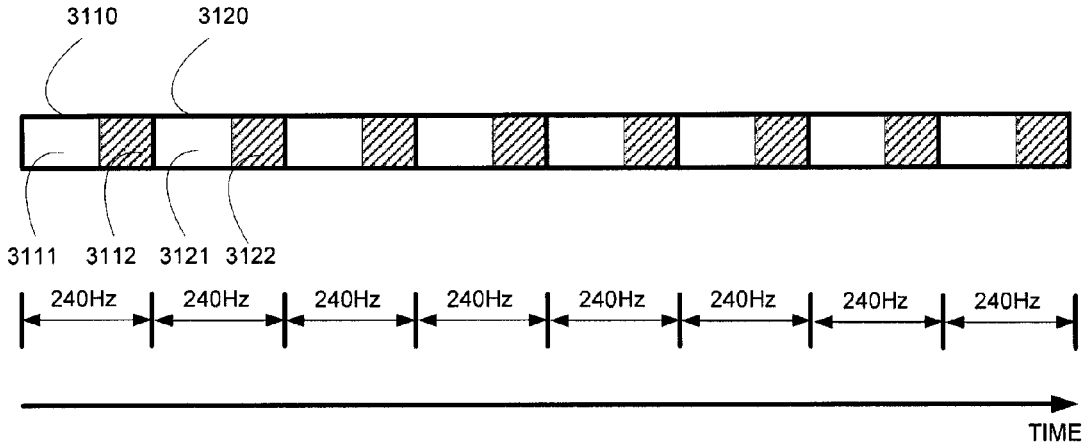
FIGS. 3A and 3B illustrates the PWM control in a first embodiment.

The driving frequency and the flashing frequency are equal to one another in the LED strings connected to the channels 1 to 10, 13, 14 corresponding to the divided areas 2101 to 2110, 2113, 2114 shown in FIG. 2B. Therefore, if the duty ratio is set to 60% in each of the driving cycles, it is possible to obtain the required flashing frequency and the luminance. FIG. 3A schematically shows the PWM signal to control the light emission of the LED strings connected to the channels 1 to 10, 13, 14 of the first LED driver 106.

In the drawing, the period indicated as 240 Hz shows the driving cycle of 240 Hz. The white portion indicates the turned-on period, and the hatched portion indicates the turned-off period. The first LED driver 106 drives the LED string connected to each of the channels 1 to 10, 13, 14 so that the turned-on period 3111 of the first driving cycle 3110 is a 60% period in the first half of the driving cycle and the turned-off period 3112 is a 40% period in the latter half of the driving cycle. The turned-on period 3121 and the turned-off period 3122 also appear at the same ratio in the next driving cycle 3120. The turning ON and the turning OFF are hereafter repeated in the same manner.

On the other hand, the flashing frequency is different from the driving frequency in the LED strings connected to the channels 11, 12, 15, 16 corresponding to the divided areas 2111, 2112, 2115, 2116 shown in FIG. 2B. Therefore, even if the duty ratio is merely set to 60% in each of the driving cycles, it is impossible to obtain the required flashing frequency. Accordingly, the backlight control unit 105 deals with the four driving cycles as one unit to individually set the duty ratio of each of the driving cycles in one unit with respect to the channel corresponding to each of the divided areas. The number of the driving cycles for constructing one unit resides in the ratio of the driving frequency with respect to the flashing frequency. In this case, the flashing frequency is 60 Hz, and the driving frequency is 240 Hz. Therefore, the four driving cycles are dealt with as one unit.

The backlight control unit 105 determines the respective duty ratios of the four driving cycles for constructing one cycle (1/60 second) of the flashing so that one cycle of the flashing is divided into two, i.e., into one turned-on period and one turned-off period. The backlight control unit 105 determines the respective duty ratios of the four driving cycles so that the ratio of the turned-on period with respect to one cycle of the flashing is the duty ratio (60% in this case) determined depending on the required luminance. That is, the backlight control unit 105 sets the respective duty ratios of the four driving cycles so that the turned-on period is the first half 60% of the flashing cycle which is the period corresponding to the four driving cycles and the turned-off period is the latter half 40%. Accordingly, the flashing of LEDs is equivalent to the flashing of LEDs to be obtained when the LEDs are subjected to the light emission control with a PWM signal having a driving frequency of 60 Hz and a duty ratio of 60%.

That is, the setting is made such that the turning ON is given in the entire period (duty ratio: 100%) for initial M piece or pieces of the driving cycle or cycles of the four driving cycles, a duty ratio of d % is given for subsequent one driving cycle continued thereto, and the turning OFF is given in the entire period (duty ratio: 0%) for remaining (4−M−1) piece or pieces of the driving cycle or cycles. In this case, it is assumed that the turned-on period is provided earlier. However, it is also allowable that the turned-off period is provided earlier.

Figure 3B:
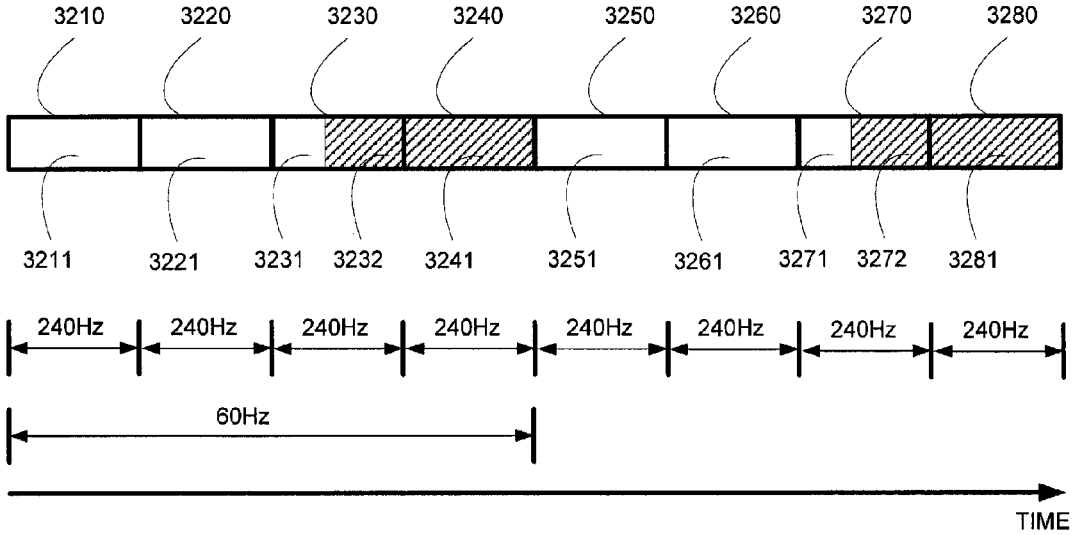

In an example shown in FIG. 3B, the backlight control unit 105 sets the duty ratio to 100% in the first driving cycle 3210. Accordingly, the turned-on period 3211 occupies the entire driving cycle 3210, and any turned-off period does not appear in this situation. The backlight control unit 105 effects the turning ON at a duty ratio of 100% as well without changing the setting for the next driving cycle 3220. Accordingly, the turned-on period 3221 occupies the entire driving cycle 3220. The backlight control unit 105 changes the setting so that the duty ratio is 40% in the next driving cycle 3230. Accordingly, the turned-on period 3231 occupies 40% of the driving cycle, and the turned-off period 3232 occupies 60% of the driving cycle 3230.

The backlight control unit 105 changes the duty ratio to 0% in the next driving cycle 3240 and thus the turned-off period 3241 occupies the entire driving cycle 3240. Assuming that the four driving cycles, i.e., the driving cycles 3210, 3220, 3230, and 3240 are one cycle of the PWM signal of 60 Hz, the turned-on periods 3211, 3221, and 3231 occupy 60% of the four driving cycles, and the turned-off periods 3232, 3241 occupy 40% of the four driving cycles. Therefore, it is possible to perform substantially the same flashing as that obtained when the light emission is effected with a PWM signal in which the driving frequency is 60 Hz and the duty ratio is 60%.

The backlight control unit 105 also performs the same control for the subsequent four driving cycles 3250 to 3280, and the same control is repeated thereafter while dealing with the four driving cycles as one unit. Accordingly, the LED strings, which are connected to the channels 11, 12, 15, 16, can be subjected to the flashing at the flashing frequency of 60 Hz while being driven at the driving frequency of 240 Hz by the first LED driver 106.

As described above, in this embodiment, the driving frequency is determined so that the required frequency for the LED flashing is 1/N (N is an integer of not less than 1) of the driving frequency of the LED driver IC. As for the LED string in which N is not less than 2, each of the duty ratios of N pieces of the driving cycles for constructing one cycle of the flashing of the LED string is determined so that the one cycle of the flashing is divided into two, i.e., one turned-on period and one turned-off period. In another viewpoint, when at least two light sources are flashed or subjected to the flashing at different flashing frequencies, if the condition, in which each of the flashing frequencies of the concerning two light sources is 1/N of the driving frequency, is fulfilled, then the duty ratio is determined as described above for the light source in which N is not less than 2. Accordingly, the duty ratio is 0% (turning OFF is given in the entire period) or the duty ratio is 100% (turning ON is given in the entire period) in at least one cycle of N pieces of the driving cycles for constructing one cycle of the flashing in relation to the LED string in which N is not less than 2.

Specifically, assuming that N represents the ratio of the driving frequency with respect to the flashing frequency, one cycle of the flashing is composed of N pieces of the driving cycles. Among them, the duty ratio is 100% (turning ON is given in the entire period) for M ($0 \le M \le N$) piece or pieces of the driving cycle or cycles as counted from the beginning. The duty ratio is d ($0 \le d \le 1$) for one driving cycle started from the subsequent turned-on period continued thereto. The duty ratio is 0% (turning OFF is given in the entire period) for subsequent (N−M−1) piece or pieces of the driving cycle or cycles continued thereto. If the duty ratio D ($0 \le D \le 1$) is given corresponding to the target luminance on the basis of the relationship between the target luminance and the duty ratio as determined for the ordinary LED string in which N is 1, M and d are determined so that (M+d)/N=D is fulfilled. An example shown in FIG. 3B shows an exemplary case in which M=2 and d=0.4 are determined on the basis of the foregoing expression if N=4 and D=0.6 are given. The backlight control unit 105 may previously store the relationship between the driving frequency and the combination of the required flashing frequencies, the relationship between the target luminance and the duty ratio D, and the relationship among the ratio N between the flashing frequency and the driving frequency, the duty ratio D, and M and d described above. In this case, the backlight control unit 105 makes reference to the relationship as described above to thereby determine the respective duty ratios of N pieces of the driving cycles for constructing one cycle of the flashing. The foregoing explanation is made while assuming such a case that the PWM signal starts from the turned-on period. However, if the PWM signal starts from the turned-off period, the respective duty ratios of N pieces of the driving cycles are as follows for constructing one cycle of the flashing of the light source in which N is not less than 2. That is, the duty ratio of 0% is given for (N−M−1) piece or pieces of the driving cycle or cycles as counted from the beginning, the duty ratio of d is given for subsequent one driving cycle started from the turned-off period continued thereto, and the duty ratio of 100% is given for subsequent M piece or pieces of the driving cycle or cycles continued thereto.

Accordingly, the plurality of LED strings, which are connected to one LED driver IC, can be flashed at the different frequencies while being driven at the identical driving frequency.

This embodiment exemplarily shows the control to be performed when the boundary between the still image area and the moving image area in the screen is coincident with the boundary of the divided area corresponding to one LED string (one channel). However, it is not necessarily the case that the boundaries are always coincident with each other. When the boundary between the still image area and the moving image area exists in one divided area, the flashing frequency of the LED block corresponding to the divided area may be determined depending on the type of the image having a larger areal size in the divided area. Alternatively, it is also allowable that the priority is always given to any one of the flashing frequency for displaying the still image and the flashing frequency for displaying the moving image.

The present invention is also applicable to an image display apparatus comprising a detecting unit which detects an extent or magnitude (speed) of motion of a moving image, for example, by means of vector analysis, wherein a flashing frequency is determined for each of LED blocks depending on the detected magnitude of the motion of the moving image. In this case, the image display apparatus detects the magnitude of the motion of the moving image for each of the divided areas corresponding to the respective LED blocks in the image display area of the liquid crystal panel. In the image display apparatus, the frequency of the LED flashing of the LED block corresponding to the area in which the magnitude of the motion is larger than a predetermined reference value is lowered as compared with the frequency of the LED flashing of the LED block corresponding to the area in which the magnitude of the motion is not more than the reference value.

In this case, the area in which LEDs perform the flashing at a high frequency and the area in which LEDs perform the flashing at a low frequency are present in a mixed manner in one screen. According to the present invention, the flashing operations, which are performed at the different frequencies as described above, can be realized by using the LED driver which drives the plurality of LEDs by using the identical driving frequency. Therefore, the light sources of the backlight can be flashed or subjected to the flashing at the different frequencies by using the simple circuit of the low cost without providing any LED driver which is capable of changing the driving frequency for each of channels and/or providing clock sources of a number corresponding to a number of channels.

Second Embodiment

In this embodiment, an explanation will be made about another use case in which it is necessary to provide different flashing frequencies for a plurality of LED strings which are connected to an identical LED driver IC and which are driven at an identical driving frequency. LEDs have individual differences. Even when an identical current is allowed to flow through a plurality of LEDs, and the PWM control is performed with an identical duty ratio, then the difference appears in the luminance of each of LEDs in some cases. In the case of an LED backlight which uses a plurality of LEDs as light sources, if the backlight is used while leaving the difference in the luminance of each of LEDs, any unevenness appears on the screen.

In view of the above, a method is known, in which the luminances are measured for the respective LED strings to correct the unevenness by changing the current amount and/or the duty ratio for each of the LED strings. The correction of unevenness as described above can be realized by measuring the characteristics of the respective LED strings upon the production. However, any difference is provided for the turn ON period of time and the current amount allowed to flow through each of the LED strings in order to correct the unevenness. Therefore, any dispersion arises in the luminance of each of the LED strings on account of the aging change during the process of use.

In order to correct the unevenness caused by the change of the light emission characteristic brought about by the aging change, it is necessary that a sensor should be provided in a backlight unit to detect the luminance of each of the LED strings even during the operation of the backlight, and the current amount and/or the duty ratio of PWM should be corrected on the basis of an obtained detection result.

Figure 4:
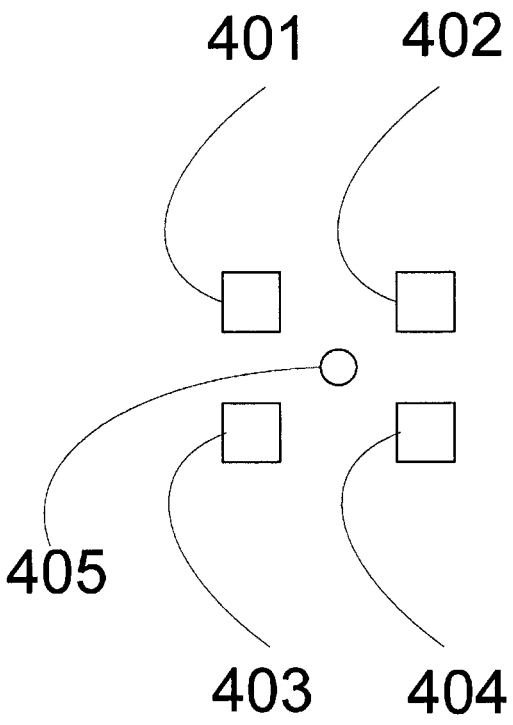
FIG. 4 illustrates an arrangement of LEDs and a sensor in a second embodiment.

FIG. 4 shows an exemplary arrangement of LEDs and a sensor in a backlight unit. With reference to FIG. 4, four LEDs 401, 402, 403, 404 represent LED strings which are connected to different channels of an identical LED driver IC respectively. In this case, in order to simplify the explanation, it is assumed that one LED string is constructed by one LED. The sensor 405 can detect the luminances of LEDs 401, 402, 403, 404.

The sensor 405 detects all of the lights of LEDs 401, 402, 403, 404 disposed in the vicinity thereof. Therefore, the sensor 405 cannot detect the luminances of individual LEDs. A method, in which the flashing frequency is changed for each of LEDs, is known as a method for detecting the luminances of individual LEDs by means of the sensor 405 while using the backlight. An explanation will be made in this section about an example in which only the flashing frequency of LED 404 is made lower than the flashing frequencies of the other LEDs 401 to 403 while driving LEDs 401 to 404 at an identical driving frequency in order to detect the luminance of LED 404. An explanation will be made specifically below with reference to FIG. 5.

Figure 5:
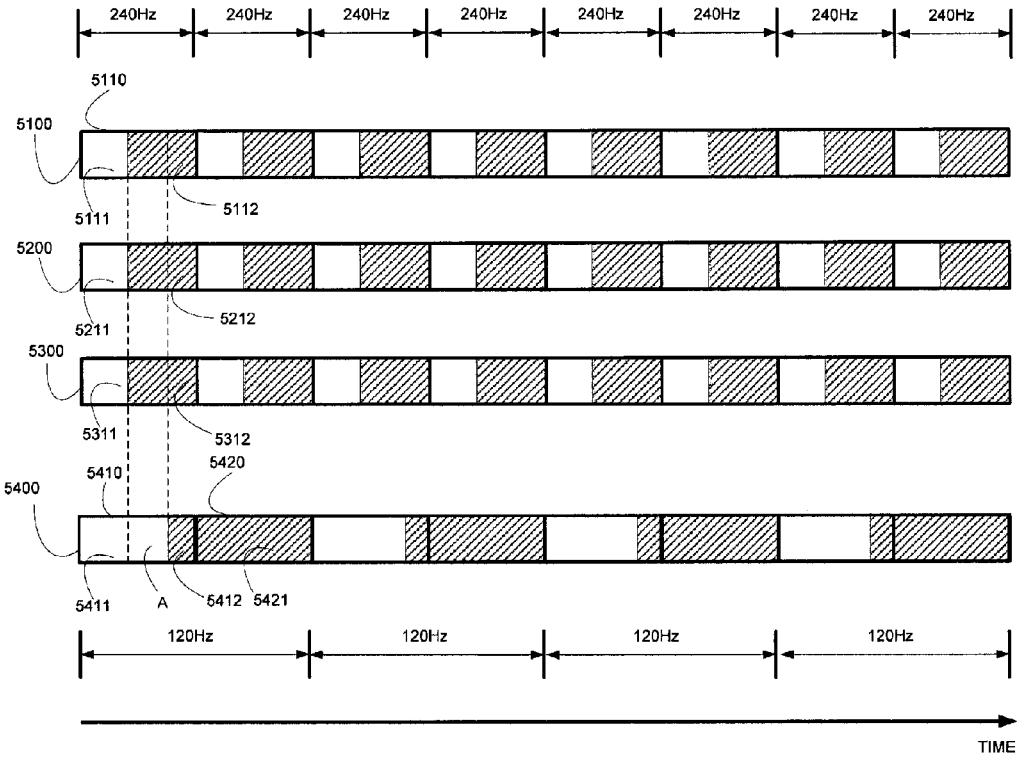
FIG. 5 illustrates the PWM control in the second embodiment.
Figure 6A:
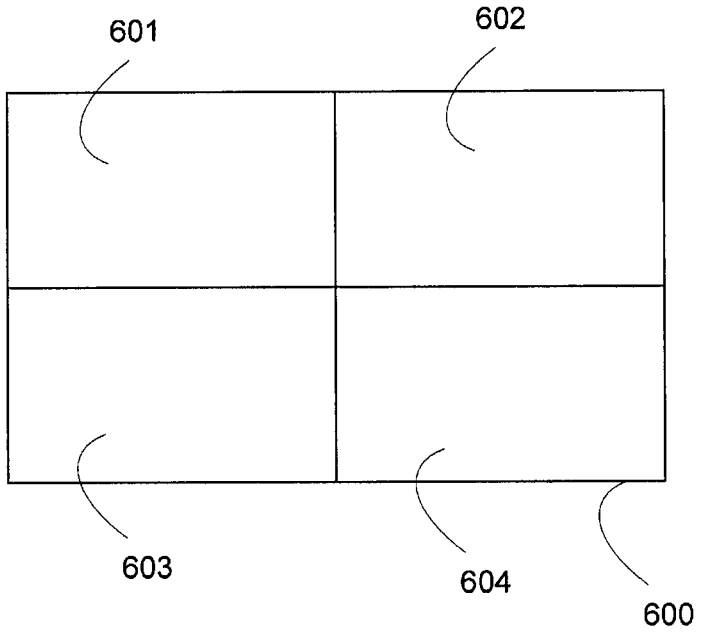
FIGS. 6A and 6B shows an exemplary screen controlled by LED driver IC shown in FIG. 7.
Figure 6B:
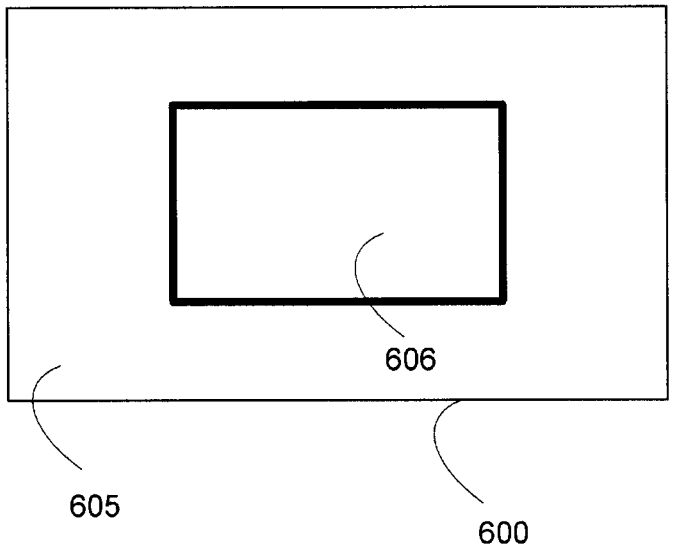
Figure 7:
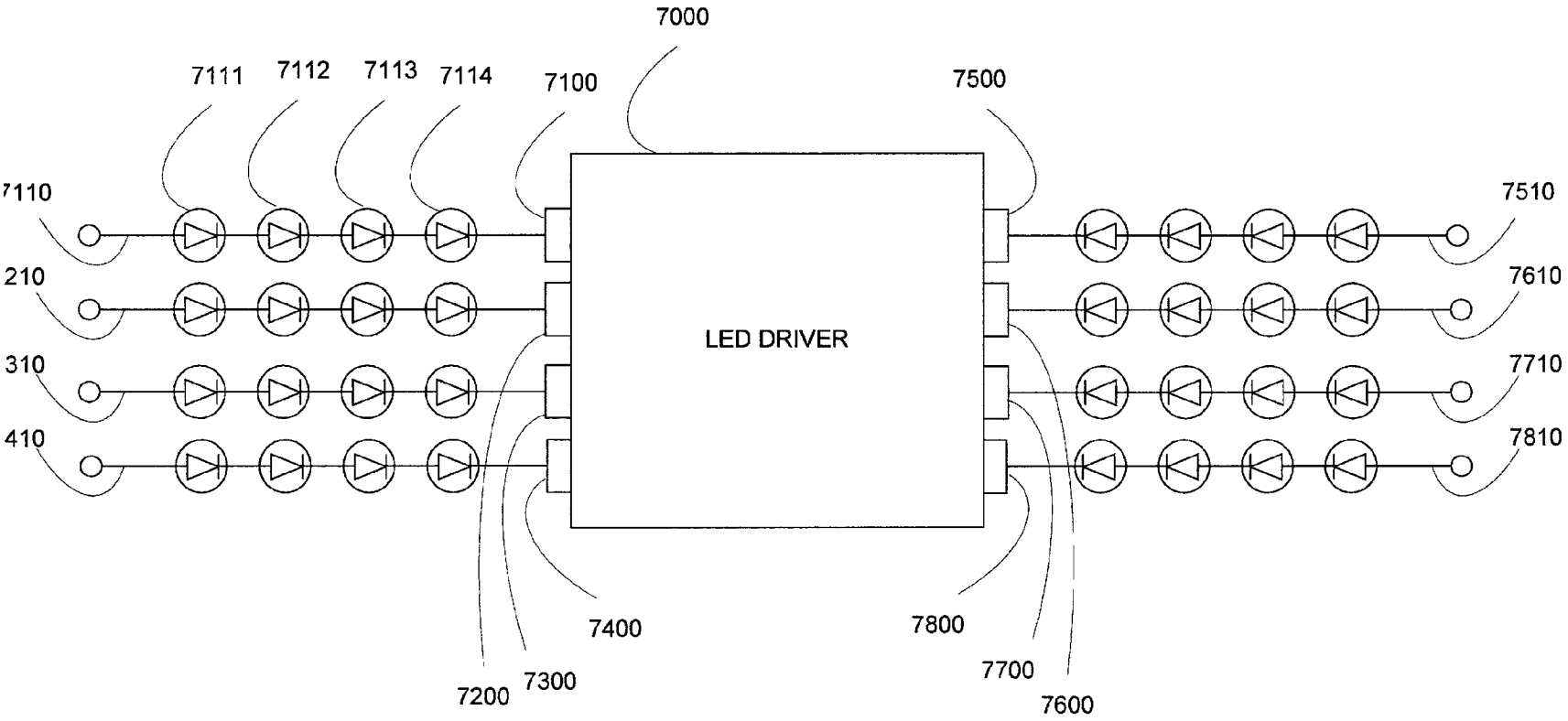
FIG. 7 shows an example of LED driver IC.

FIG. 5 schematically shows PWM signals 5100, 5200, 5300, 5400 for LEDs 401, 402, 403, 404 respectively, in which the driving cycles corresponding to eight cycles are shown. As shown in FIG. 5, the driving frequency of each LED is 240 Hz. In this case, LED 401, LED 402, and LED 403 perform the flashing at 240 Hz. The duty ratio is set by using a plurality of driving cycles as a unit for only LED 404 which is the luminance detection objective to be detected by the sensor. In this procedure, the number of driving cycles for constructing one unit is two, i.e., two cycles constitute one unit. The respective duty ratios of the two driving cycles are set so that the flashing of LED, which is based on the flashing cycle of the period corresponding to the two driving cycles, is equivalent to the flashing of LED which is to be obtained when the light emission control is performed for LED with a PWM signal having a driving frequency of 120 Hz and a duty ratio of 40%.

That is, the respective duty ratios of the two driving cycles are set so that the first half 40% of the period corresponding to the two cycles is the turned-on period, and the latter half 60% is the turned-off period. In this case, in the PWM signal 5400 for LED 404, the duty ratio is changed for every one driving cycle. As shown in FIG. 5, in the first driving cycle 5410, the duty ratio is set to 80%. Accordingly, the turned-on period 5411 occupies 80% of the driving cycle 5410, and the turned-off period 5412 occupies 20%.

In the next driving cycle 5420, the duty ratio is set to 0%. Accordingly, the turned-off period 5421 occupies the entire period of the driving cycle 5420. Accordingly, assuming that one cycle is formed by the driving cycles corresponding to the two of the driving cycles 5410, 5420, the turned-on period 5411 firstly appears, and the turned-off periods 5412, 5421 continue thereafter. Therefore, LED 404 performs the same flashing as the flashing to be performed with a PWM signal in which the driving frequency is 120 Hz and the duty ratio is 40%.

In this situation, the latter half portion A, which is a part of the turned-on period 5411 of LED 404, corresponds to the portions of the turned-off period 5112 of LED 401, the turned-off period 5212 of LED 402, and the turned-off period 5312 of LED 403. Therefore, LED, which is turned ON, is only LED 404 in the period A. Therefore, it is possible to measure the luminance of only LED 404 without being affected by other LEDs.

When the luminance of LED other than LED 404 is measured, it is appropriate to change the flashing frequency of LED as the measurement objective so that the period, in which only LED to be measured is turned ON, is generated in the same manner as described above. It is possible to measure the luminances of individual LEDs by changing the flashing frequency of only LED as the measurement objective as described above.

The respective embodiments described above are illustrative of the exemplary case in which the two different types of flashing frequencies of LEDs are 60 Hz and 240 Hz, wherein the driving frequency is set to 240 Hz which is the least common multiple thereof. In the present invention, the driving frequency may be set to an integral multiple of the least common multiple of a plurality of types of flashing frequencies. For example, in the exemplary case described above, the setting may be made to n (n=1, 2, . . . ) times 240 Hz, for example, 480 Hz. In the respective embodiments described above, the higher flashing frequency is equal to the driving frequency. However, any one of the flashing frequencies is not coincident with the driving frequency depending on the flashing frequency to be required, in some cases. For example, when the flashing frequencies are 60 Hz and 90 Hz, the driving frequency is 180 Hz which is the least common multiple thereof, or any frequency which is an integral multiple of 180 Hz. Therefore, any one of the flashing frequencies has the value different from that of the driving frequency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-144101, filed on Jun. 29, 2011, and Japanese Patent Application No. 2012-100140, filed on Apr. 25, 2012, which are hereby incorporated by reference herein in their entirety.

What is claimed is:

1. A backlight apparatus comprising:

a plurality of light sources; and a control unit which drives the plurality of light sources at an identical driving frequency and which performs pulse-width modulation control for a turned-on period and a turned-off period of each of the light sources, wherein:

the control unit is capable of setting a duty ratio between the turned-on period and the turned-off period for each of the light sources and each of driving cycles;

the control unit sets the duty ratio, for at least two of the light sources respectively, so that a condition, in which one cycle period composed of one turned-on period and one turned-off period is N times the driving cycle, wherein N is an integer of not less than 1, is fulfilled, and the duty ratio is 0 or 1 in at least one driving cycle of N pieces of the driving cycles for constructing the one cycle period if N is not less than 2; and the control unit driving the frequency is a least common multiple of reciprocals of the one cycle periods of the plurality of light sources, and determines the duty ratios of the respective light sources so that the light source, which has the one cycle period shorter than that of the light source in which N is not less than 2, is in the turned-off period in at least a partial period of the turned-on period of the light source in which N is not less than 2.

wherein the driving frequency is a least common multiple of reciprocals of the one cycle periods of the plurality of light sources.

2. The backlight apparatus according to claim 1, wherein the control unit controls the light source in which N is not less than 2 such that a duty ratio of 1 is given for M ($0 \le M \le N$) piece or pieces of the driving cycle or cycles as counted from beginning of N pieces of the driving cycles for constructing the one cycle period of the concerning light source, a duty ratio of d ($0 \le d \le 1$) is given for subsequent one piece of the driving cycle started from the turned-on period, and a duty ratio of 0 is given for subsequent (N−M−1) piece or pieces of the driving cycle or cycles, or a duty ratio of 0 is given for (N−M−1) piece or pieces of the driving cycle or cycles from beginning, a duty ratio of d is given for subsequent one piece of the driving cycle started from the turned-off period, and a duty ratio of 1 is given for subsequent M piece or pieces of the driving cycle or cycles.

3. The backlight apparatus according to claim 2, wherein the control unit reads a predetermined relationship between a target luminance and the duty ratio from a storage unit for the light source in which N is 1, and the control unit determines M and d for the light source in which N is not less than 2 so that $(M+d)/N=D$ holds if a duty ratio D ($0 \le D \le 1$), which is determined on the basis of the relationship depending on the target luminance of the concerning light source, is given.

4. The backlight apparatus according to claim 1, further comprising:

a detecting unit which detects luminances of the plurality of light sources, wherein:

the control unit operates, when the luminance of any one light source of the plurality of light sources is detected by the detecting unit, such that N is not less than 2 for the light source as a luminance detection objective, the one cycle period of each of the other light sources is shorter than the one cycle period of the light source as the luminance detection objective, and the duty ratios of the plurality of light sources are determined so that the light sources other that the light source as the luminance detection objective are in the turned-off periods in at least a partial period of the turned-on period of the light source as the luminance detection objective; and the detecting unit detects the luminance of the light source as the luminance detection objective in the period in which the light source as the luminance detection objective is in the turned-on period and the other light sources are in the turned-off periods.

5. The backlight apparatus according to claim 4, further comprising a correcting unit which corrects the luminance of the light source as the luminance detection objective on the basis of a detection result obtained by the detecting unit.

6. An image display apparatus comprising:

the backlight apparatus as defined in claim 1; and a liquid crystal panel which is illuminated by the backlight apparatus.

7. The image display apparatus according to claim 6, wherein:

the backlight apparatus is divided into a plurality of light source blocks, each of the light source blocks being composed of one light source or a plurality of light sources in which light emission is controlled with an identical duty ratio;

the image display apparatus further comprises a judging unit which judges whether a displayed image is a still image or a moving image for each of areas corresponding to the respective light source blocks included in an image display area of the liquid crystal panel; and the control unit operates such that the one cycle period of the light source of the light source block corresponding to the area for which it is judged that the displayed image is the moving image is longer than the one cycle period of the light source of the light source block corresponding to the area for which it is judged that the displayed image is the still image.

8. The image display apparatus according to claim 6, wherein:

the backlight apparatus is divided into a plurality of light source blocks, each of the light source blocks being composed of one light source or a plurality of light sources in which light emission is controlled with an identical duty ratio;

the image display apparatus further comprises a detecting unit which detects a magnitude of motion of a moving image of a displayed image for each of areas corresponding to the respective light source blocks included in an image display area of the liquid crystal panel; and the control unit operates such that the one cycle period of the light source of the light source block corresponding to the area in which the magnitude of motion is larger than a predetermined reference value is longer than the one cycle period of the light source of the light source block corresponding to the area in which the magnitude of motion is not more than the reference value.

9. A method for controlling a backlight apparatus having a plurality of light sources which are driven at an identical driving frequency and each of which has a turned-on period and a turned-off period subjected to pulse-width modulation control, the method comprising:

a step of setting a duty ratio between the turned-on period and the turned-off period for each of the light sources and each of driving cycles; and a step of setting a duty ratio, for at least two of the light sources respectively, so that a condition, in which one cycle period composed of one turned-on period and one turned-off period is N times a driving cycle, wherein N is an integer of not less than 1, is fulfilled, and the duty ratio is 0 or 1 in at least one driving cycle of N pieces of the driving cycles for constructing the one cycle period if N is not less than 2, wherein the duty ratios of the respective light sources are determined so that the light source, which has the one cycle period shorter than that of the light source in which N is not less than 2, is in the turned-off period in at least a partial period of the turned-on period of the light source in which N is not less than 2, wherein the driving frequency is at least common multiple of reciprocals of the one cycle periods of the plurality of light sources.

10. An image display apparatus comprising:

a backlight apparatus having:

a plurality of light sources; and a control unit which drives the plurality of light sources at an identical driving frequency and which performs pulse-width modulation control for a turned-on period and a turned-off period of each of the light sources; and a liquid crystal panel which is illuminated by the backlight apparatus, wherein:

the backlight apparatus is divided into a plurality of light source blocks, each of the light source blocks being composed of one light source or a plurality of light sources in which light emission is controlled with an identical duty ratio;

the image display apparatus further comprises a detecting unit which detects a magnitude of motion of a moving image of a displayed image for each of areas corresponding to the respective light source blocks included in an image display area of the liquid crystal panel;

the control unit is capable of setting a duty ratio between the turned-on period and the turned-off period for each of the light sources and each of driving cycles;

the control unit sets the duty ratio, for at least two of the light sources respectively, so that a condition, in which one cycle period composed of one turned-on period and one turned-off period is N times the driving cycle, wherein N is an integer of not less than 1, is fulfilled, and the duty ratio is 0 or 1 in at least one driving cycle of N pieces of the driving cycles for constructing the one cycle period if N is not less than 2; and the control unit operates such that the one cycle period of the light source of the light source block corresponding to the area in which the magnitude of motion is larger than a predetermined reference value is longer than the one cycle period of the light source of the light source block corresponding to the area in which the magnitude of motion is not more than the reference value, wherein the driving frequency is a least common multiple of reciprocals of the one cycle periods of the plurality of light sources.

11. The image display apparatus according to claim 10, wherein the control unit controls the light source in which N is not less than 2 such that a duty ratio of 1 is given for M (0<M<N) piece or pieces of the driving cycle or cycles as counted from beginning of N pieces of the driving cycles for constructing the one cycle period of the concerning light source, a duty ratio of d (0<d<1) is given for subsequent one piece of the driving cycle started from the turned-on period, and a duty ratio of 0 is given for subsequent (N−M−1) piece or pieces of the driving cycle or cycles, or a duty ratio of 0 is given for (N−M−1) piece or pieces of the driving cycle or cycles from beginning, a duty ratio of d is given for subsequent one piece of the driving cycle started from the turned-off period, and a duty ratio of 1 is given for subsequent M piece or pieces of the driving cycle or cycles.

12. The image display apparatus according to claim 11, wherein the control unit reads a predetermined relationship between a target luminance and the duty ratio from a storage unit for the light source in which N is 1, and the control unit determines M and d for the light source in which N is not less than 2 so that (M+d)/N=D holds if a duty ratio D (0<D<1), which is determined on the basis of the relationship depending on the target luminance of the concerning light source, is given.

13. The image display apparatus according to claim 12, wherein the control unit determines the duty ratios of the respective light sources so that the light source, which has the one cycle period shorter than that of the light source in which N is not less than 2, is in the turned-off period in at least a partial period of the turned-on period of the light source in which N is not less than 2.

14. The image display apparatus according to claim 10, further comprising:

a detecting unit which detects luminances of the plurality of light sources, wherein:

the control unit operates, when the luminance of any one light source of the plurality of light sources is detected by the detecting unit, such that N is not less than 2 for the light source as a luminance detection objective, the one cycle period of each of the other light sources is shorter than the one cycle period of the light source as the luminance detection objective, and the duty ratios of the plurality of light sources are determined so that the light sources other than the light source as the luminance detection objective are in the turned-off periods in at least a partial period of the turned-on period of the light source as the luminance detection objective; and the detecting unit detects the luminance of the light source as the luminance detection objective in the period in which the light source as the luminance detection objective is in the turned-on period and the other light sources are in the turned-off periods.

15. The image display apparatus according to claim 14, further comprising a correcting unit which corrects the luminance of the light source as the luminance detection objective on the basis of a detection result obtained by the detecting unit.

16. The image display apparatus according to claim 10, wherein the driving frequency is a least common multiple of reciprocals of the one cycle periods of the plurality of light sources.

17. A method for controlling an image display apparatus comprising:

a backlight apparatus having a plurality of light sources which are driven at an identical driving frequency and each of which has a turned-on period and a turned-off period subjected to pulse-width modulation control; and a liquid crystal panel which is illuminated by the backlight apparatus, wherein the backlight apparatus is divided into a plurality of light source blocks, each of the light source blocks being composed of one light source or a plurality of light sources in which light emission is controlled with an identical duty ratio, the method comprising:

a step of detecting a magnitude of motion of a moving image of a displayed image for each of areas corresponding to the respective light source blocks included in an image display area of the liquid crystal panel;

a step of setting a duty ratio between the turned-on period and the turned-off period for each of the light sources and each of driving cycles; and a step of setting a duty ratio, for at least two of the light sources respectively, so that a condition, in which one cycle period composed of one turned-on period and one turned-off period is N times a driving cycle, wherein N is an integer of not less than 1, is fulfilled, and the duty ratio is 0 or 1 in at least one driving cycle of N pieces of the driving cycles for constructing the one cycle period if N is not less than 2; wherein the one cycle period of the light source of the light source block corresponding to the area in which the magnitude of motion is larger than a predetermined reference value is longer than the one cycle period of the light source of the light source block corresponding to the area in which the magnitude of motion is not more than the reference value, wherein the driving frequency is a least common multiple of reciprocals of the one cycle periods of the plurality of light sources.

18. A backlight apparatus comprising:

a plurality of light sources;

a control unit configured to drive the plurality of light sources at an identical driving cycle and perform pulse-width modulation control for each of the light sources; and a determining unit configured to determine whether an image displayed on each of a plurality of partial areas respectively corresponding to the plurality of light sources is a still image or a moving image, wherein the control unit is configured to set a duty ratio between a turned-on period and a turned-off period in each driving cycle for each of the plurality of light sources based on a determination result by the determining unit;

one cycle period, which is composed of one turned-on period and one turned-off period, of a first light source corresponding to a partial area on which a still image is displayed is same as a driving cycle period; and one cycle period, which is composed of one turned-on period and one turned-off period, of a second light source corresponding to a partial area on which a moving image is displayed is N times the driving cycle period, wherein N is an integer of not less than 1.

19. The backlight apparatus according to claim 18, wherein the duty ratio is 0 or 1 in at least one driving cycle of N pieces of the driving cycles composing the one cycle period of the second light source.

* * * * *